US006990709B2

(12) United States Patent
Fields

(10) Patent No.: US 6,990,709 B2
(45) Date of Patent: Jan. 31, 2006

(54) VACUUM SWEEPING SYSTEM FOR AUTOMATIC SCRUBBER

(75) Inventor: William A. Fields, Livermore, CA (US)

(73) Assignee: Surtec, Inc., Tracy, CA (US)

( * ) Notice: Subject to any disclaimer, the term of this patent is extended or adjusted under 35 U.S.C. 154(b) by 350 days.

(21) Appl. No.: 10/269,730

(22) Filed: Oct. 11, 2002

(65) Prior Publication Data

US 2004/0068825 A1 Apr. 15, 2004

(51) Int. Cl.
*A47L 7/02* (2006.01)

(52) U.S. Cl. ..... 15/349; 15/359; 15/371

(58) Field of Classification Search ..... 15/340.1, 15/340.2, 340.3, 340.4, 359, 368, 371, 420, 15/82, 83, 349
See application file for complete search history.

(56) References Cited

U.S. PATENT DOCUMENTS 2,973,544 A * 3/1961 Romaniuk ..... 15/340.1
3,054,130 A * 9/1962 Ferrari ..... 15/340.3
3,197,798 A * 8/1965 Brown et al. ..... 15/340.3
3,436,788 A * 4/1969 Tammy ..... 15/340.3
3,675,267 A * 7/1972 Klawitter ..... 15/340.1
6,018,844 A * 2/2000 Basham et al. ..... 15/340.3
6,272,720 B1 * 8/2001 Lovgren et al. ..... 15/340.4

* cited by examiner

*Primary Examiner*—Theresa T. Snider
(74) *Attorney, Agent, or Firm*—Townsend and Townsend and Crew LLP

(57) ABSTRACT

A vacuum sweeper is cantilevered to a hinged bracket mounted to the front of a conventional automatic floor scrubber. The sweeper includes a vacuum head, an overlying debris ramp, and two vertically rotating, conical brushes having their base ends in contact with the floor. The base end of the conical brushes sweep a path at the edge of the vacuum sweeper in excess of the width of the scrubber. The entire vacuum sweeper apparatus is mounted for vertical excursion relative to the cantilevered mount to the hinge bracket to enable up and down excursion of the sweeper and vacuum responsive to either scrubber motion or inevitable floor irregularities encountered during floor scrubbing. Where vacuuming is not required in advance of scrubbing, such as during double scrubbing or floor stripping cycles, provision is made to hinge the vacuum sweeper upwardly away from floor engagement. A ramp is used in conjunction with the vacuum for collecting large debris.

18 Claims, 4 Drawing Sheets

VACUUM SWEEPING SYSTEM FOR AUTOMATIC SCRUBBER

CROSS-REFERENCES TO RELATED APPLICATIONS

Not Applicable

STATEMENT AS TO RIGHTS TO INVENTIONS MADE UNDER FEDERALLY SPONSORED RESEARCH OR DEVELOPMENT

Not Applicable

REFERENCE TO A "SEQUENCE LISTING," A TABLE, OR A COMPUTER PROGRAM LISTING APPENDIX SUBMITTED ON A COMPACT DISK

Not Applicable

This invention relates to automatic scrubbers commonly used for cleaning the large floor area of modern markets and stores. More particularly, a vacuum pre-sweeping system for an automatic floor scrubber is disclosed which can easily be attached to extant scrubbers and utilized for vacuuming and sweeping to eliminate dry mopping in advance of scrubbing. A suspension system is disclosed which allows for up-and-down excursion of the vacuum sweeper system as well as movement of the system to an upward position when vacuuming and sweeping is not required.

BACKGROUND OF THE INVENTION

Modern supermarkets and stores contain large polished opened flooring in ranges from 40,000 square feet to 120,000 square feet and above. Typically, these floors are tile covered and polished or burnished with a finish that shines and gives the store a safe, clean appearance.

To maintain such floors, a four-step process is required by the prior art. First, the floor is typically dry dust mopped to clear the floor of large debris and dust. Second, the floor is scrubbed, usually with an automatic scrubber. The automatic scrubber dispenses detergent onto the floor, scrubs, and thereafter squeegees and vacuums the detergent from the floor. After the scrubbing step, the floor is polished or burnished with a buffer. Finally, after the polishing or burnishing, the floor is again dust mopped to pick up fine debris left in the wake of the polishing or burnishing operation.

Each of these discrete steps consumes time and labor. For example, utilizing machinery having a 27-inch-wide path, dry mopping can consume five minutes per thousand square feet of floor per employee. Likewise, scrubbing can consume seven minutes per thousand square feet of floor per employee. Similarly, polishing or burnishing can consume seven minutes per thousand square feet of floor per employee. Finally, the final mopping after burnishing or polishing can consume five minutes per thousand square feet per employee. Thus, 1000 square feet of floor can require up to 24 minutes per thousand square feet of employee time during regular scrubbing and polishing cycles.

It is to be noted that the above description of labor does not include so-called "double scrub" and "strip" cycles. In these latter cycles, the scrubber first dispenses detergent, scrubs with the detergent, and then leaves the detergent to dwell on the floor for a specific period of time. Thereafter, scrubbing is repeated with the detergent being gathered and recovered by the scrubber. Between the respective scrubbings, dry mopping is not utilized.

In Fields U.S. Pat. No. 5,388,305 issued Feb. 14, 1995, I have combined the polishing and burnishing cycle with the second dry mopping cycle. Simply stated, I disclose a polishing and vacuuming apparatus having a revolving head surrounded by a skirt which biases to and towards the floor. The skirt is provided with a series of serrated slits angularly inclined with respect to the rotating polishing and burnishing brush. The slits draw air from the exterior of the burnishing apparatus through the skirt into the interior of the burnishing apparatus at the skirt. Thereafter, by providing the combination of a deflector and a vacuum apparatus, I gather to a micro filter vacuum bag the dust and debris generated by the polishing and burnishing operation. This improvement to the polishing and burnishing operation has experienced commercial success and eliminated approximately five minutes of labor per thousand square feet of floor maintained assuming 27-inch-wide polishing equipment is used.

To date, there has been no equivalent improvement to the wet scrubbing operation.

Automated floor sweepers are known. In one such sweeper, counter-rotating conical brushes are used on the sweeper ends. These brushes each rotate about vertical axes at opposite sides of the sweeper. Sweeping of the counter-rotating brushes occurs at a central ramp which typically is maintained a small constant distance above the floor. In some cases, a large cylindrical brush rotating about a horizontal axis in front of the debris ramp cooperates with the counter-rotating conical brushes to sweep large debris up the ramp and into a collector. No vacuuming provision is made for the collection of dust.

Unfortunately, it is my experience that such sweepers are inadequate when utilized immediately before a scrubbing operation. Specifically, they are successful in collecting the large debris only and constitute a separate operation adding additional labor. They also lack the ability to collect fine particles and dust. Uncollected fine particles and dust give a "mud like" appearance to the floor in the wake of the wet scrubbing apparatus and constitute a serious degradation to the floor maintenance cycle. As a consequence, conventional dry mopping is almost always used before a floor scrubbing operation.

There have been attempts to combine the dry mopping, scrubbing, and polishing and burnishing operation. Machines making such combinations have at least three problems. First, where the machines are battery operated, conventional battery operation has difficulty in simultaneously powering the sweeping, scrubbing, and polishing apparatus. In order to enable these three steps to be simultaneously powered from the same battery pack, machines of reduced width are required. As of this disclosure, combined sweeping, scrubbing, and polishing and/or burnishing machines have a width which does not exceed 20 inches due to the energy required to run sweeping, scrubbing, and polishing and/or burnishing operations simultaneously.

Second, such machines are long with all three components in a straight line, one after the other. They do not operate efficiently on sharp turns such as those required to pass around the counter ends between aisles. A separate maneuver is required to align such machines for each pass down the floor aisles between the counters. Wasted time and energy results.

Third, polishing and burnishing directly after scrubbing requires additional time. Since such machines are series machines, they can proceed at a speed no greater than the efficiency of the slowest component. In this case, it is the slow polishing cycle immediately after wet scrubbing the floor. For example, and utilizing a 20-inch machine, polishing and burnishing immediately after scrubbing results in the polishing and burnishing operation occurring on a semi dry surface. This semi dry surface can require up to 15 minutes per thousand square feet per employee with such a machine. The efficiency originally sought in the combined pre-sweeping, scrubbing and polishing and/or burnishing is not realized.

BRIEF SUMMARY OF THE INVENTION

A vacuum sweeper is cantilevered to a hinged bracket mounted to the front of a conventional automatic floor scrubber. The sweeper includes a central vacuum head, an overlying central debris ramp, and two vertically rotating, conical brushes having their base ends in contact with the floor. The base end of the conical brushes sweep a path at the edge of the vacuum sweeper in excess of the width of the scrubber. This enables sweeping to the edges of floor-standing counters at their inset kick plates. The base end of each of the conical brushes rotates large debris to and toward the ramp overlying the vacuum entrance to sweep the large debris up the ramp and into a following drawer mounted hopper. The base end of each of the conical brushes rotates small debris, such as dust, into the vacuum head on the underside of the ramp. The vacuum head is mounted between the counter-rotating conical brushes and defines a small gap over the floor being swept and vacuumed on the order of ⅜ of an inch. The rear and sides of the vacuum head are enclosed by substantially airtight bristle walls which slide over the floor surface behind the gap. Immediately adjacent to the gap, paired rollers support the forward lip to maintain the small gap at the leading edge of the vacuum head. When a vacuum is pulled upon the vacuum head, the energy of the vacuum is confined to and concentrated at the gap at the leading edge of the vacuum head. This produces a concentration of vacuum energy at the gap for the removal of small debris, such as dust. The entire vacuum sweeper apparatus is mounted for vertical excursion relative to the cantilevered mount to the hinge bracket to enable up and down excursion of the sweeper and vacuum responsive to either scrubber motion or inevitable floor irregularities encountered during floor scrubbing. Where vacuuming is not required in advance of scrubbing, such as during double scrubbing or floor stripping cycles, provision is made to hinge the vacuum sweeper upwardly away from floor engagement.

As can be seen, I disclose a vacuum sweeper process and apparatus for use immediately before scrubbing. By combining vacuum sweeping with the scrubbing apparatus and process, I effectively eliminate the dust mopping step prior to scrubbing to achieve a superior time-saving result by combining the vacuum pre-sweeping with the scrubbing. Additionally, by isolating vacuum sweeping and scrubbing to one apparatus, and maintaining polishing and burnishing with fine particle vacuum gathering to a second apparatus, I affect an overall 40 percent saving in the conventional four step floor maintenance cycle. Each apparatus processes approximately 1000 square feet of floor area every seven minutes utilizing an apparatus having a 27 inch width. Thus, utilizing the floor cleaning apparatus of my Fields U.S. Pat. No. 5,388,305 issued Feb. 14, 1995 and the disclosed apparatus herein, I can reduce what was a 24 minutes cycle per thousand square feet per employee to a 14 minutes cycle per thousand square feet per employee for an overall labor saving in the order of 40 percent.

DETAILED DESCRIPTION OF THE INVENTION

Figure 1:
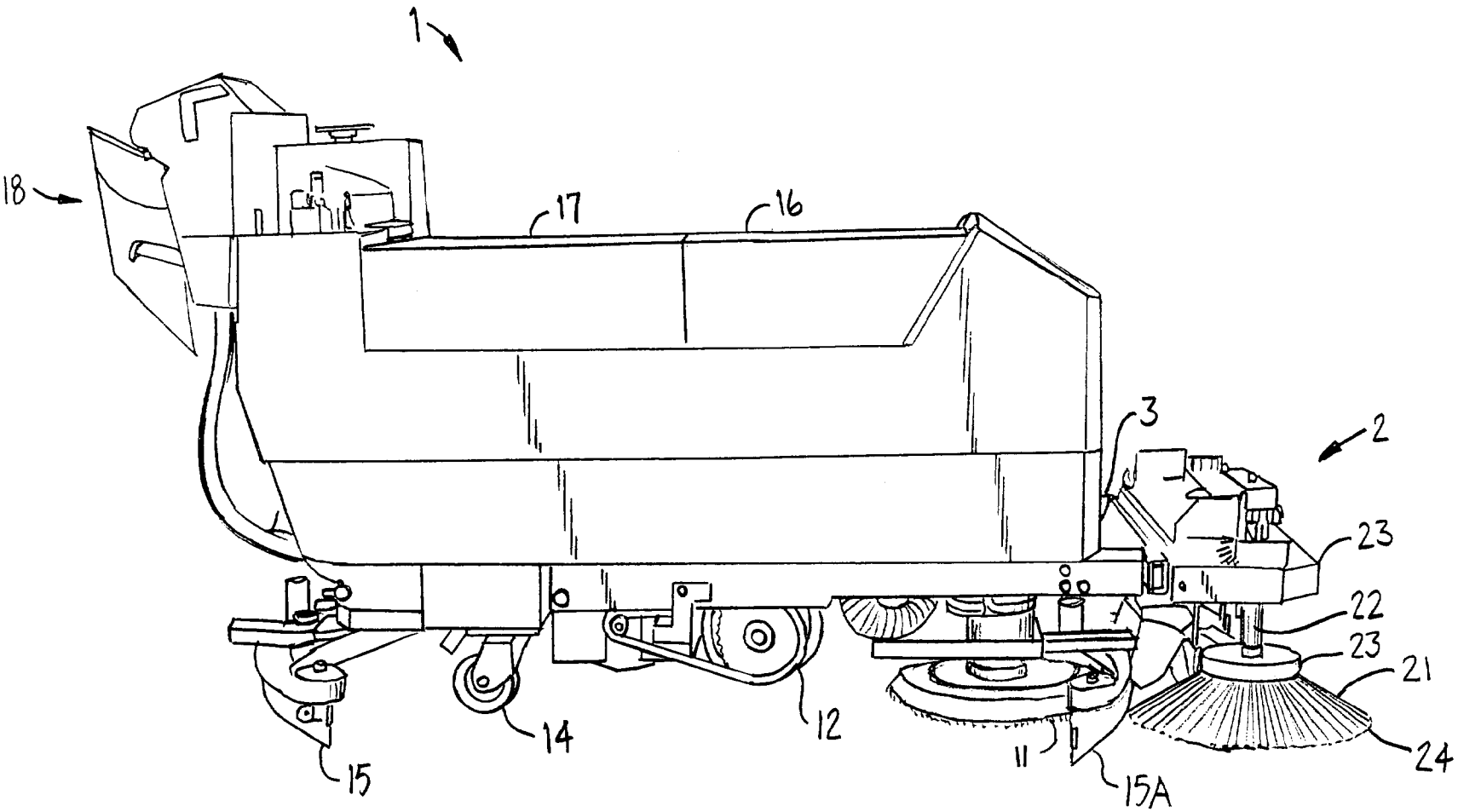
FIG. 1 is a side elevation view of a conventional floor scrubber having the vacuum sweeper of this disclosure mounted and hinged at the forward end of the scrubber for sweeping and vacuuming the floor in the path of the scrubber.

Referring to FIG. 1, automatic scrubber 1 is shown having vacuum sweeper 2 mounted at the forward end of scrubber 1. The normal direction of scrubber movement proceeds from the left of FIG. 1 to the right of FIG. 1 so that vacuum sweeper 2 sweeps the floor in advance of scrubber 1.

Automatic scrubber 1 is typical of scrubbers common to the marketplace. It includes a foreword rotating scrubbing brush 11 which is suspended from the main scrubber body. A medial propelling wheel 12 drives and supports automatic scrubber 1 as it is propelled along the floor. Rear supporting casters 14 in effect pivot automatic scrubber 1 about the medial propelling wheel 12. Finally, there is a detergent removing squeegee 15 suspended at the rear of the scrubber 1. Automatic scrubber 1 dispenses detergent, scrubs the floor utilizing the detergent, and recovers the used detergent by squeeging and vacuuming the detergent from the floor.

It will be understood that scrubbing brush 11 must be shielded. Specifically, if left unobstructed as viewed in FIG. 1, considerable splatter of dispensed detergent would occur from the floor scrubbing operation. It is common to provide a shielding skirt around the periphery of the scrubber—especially in the vicinity of scrubbing brush(s) 11 to prevent such splatter. Further, such a skirt is virtually required between the pre-sweeping vacuuming attachment here disclosed and the scrubbing brush 11. As all such automatic scrubbers are supplied with these skirts, they will not be shown here in the interests of letting the reader understand the suspension and operation of the automatic scrubber here disclosed.

In the case of the vacuum sweeper 2, I prefer to place a squeegee 15*a* between vacuum sweeper 2 and scrubber 1. This assures that vacuum sweeping occurs in a dry environment.

Ignoring for the moment the operation of vacuum sweeper 2, the conventional operation of automatic scrubber 1 is easy to understand. Automatic scrubber 1 is propelled from left to right in FIG. 1. Detergent tank 16 supplies detergent at rotating scrubbing brush 11. Scrubbing brush effects scrubbing of the floor. The scrubber is propelled so that detergent removing squeegee 15 squeegees and vacuums detergent and scrubbed debris to detergent recovery tank 17. Automatic scrubber 1 here shown is operated by an operator from operator station 18, who walks behind the scrubber and guides it.

Automatic scrubber 1 will be understood to be exemplary of commercial scrubbers that are now extant. From the description given thus far, two important points can be made about automatic scrubber 1 and the mounting of vacuum sweeper 2 at the forward end of the scrubber. First, the scrubber will inevitably pass over floor irregularities. Such irregularities will cause the front portion of the scrubber 1, especially at a mounted vacuum sweeper 2 to move up and down. Second, automatic scrubber 1 will tend to pivot on medial propelling wheel 12. In such pivoting, vacuum sweeper 2 will again tend to move up and down. As will be hereinafter set forth, vacuum sweeper 2 is mounted to the front of automatic scrubber 1 so that such up-and-down movement can be accommodated without lifting the vacuum sweeper 2 from the floor. Preferably, vacuum sweeper 2 is biased to and towards the floor to maintain a firm sweeping and vacuuming contact with the floor.

Figure 2:
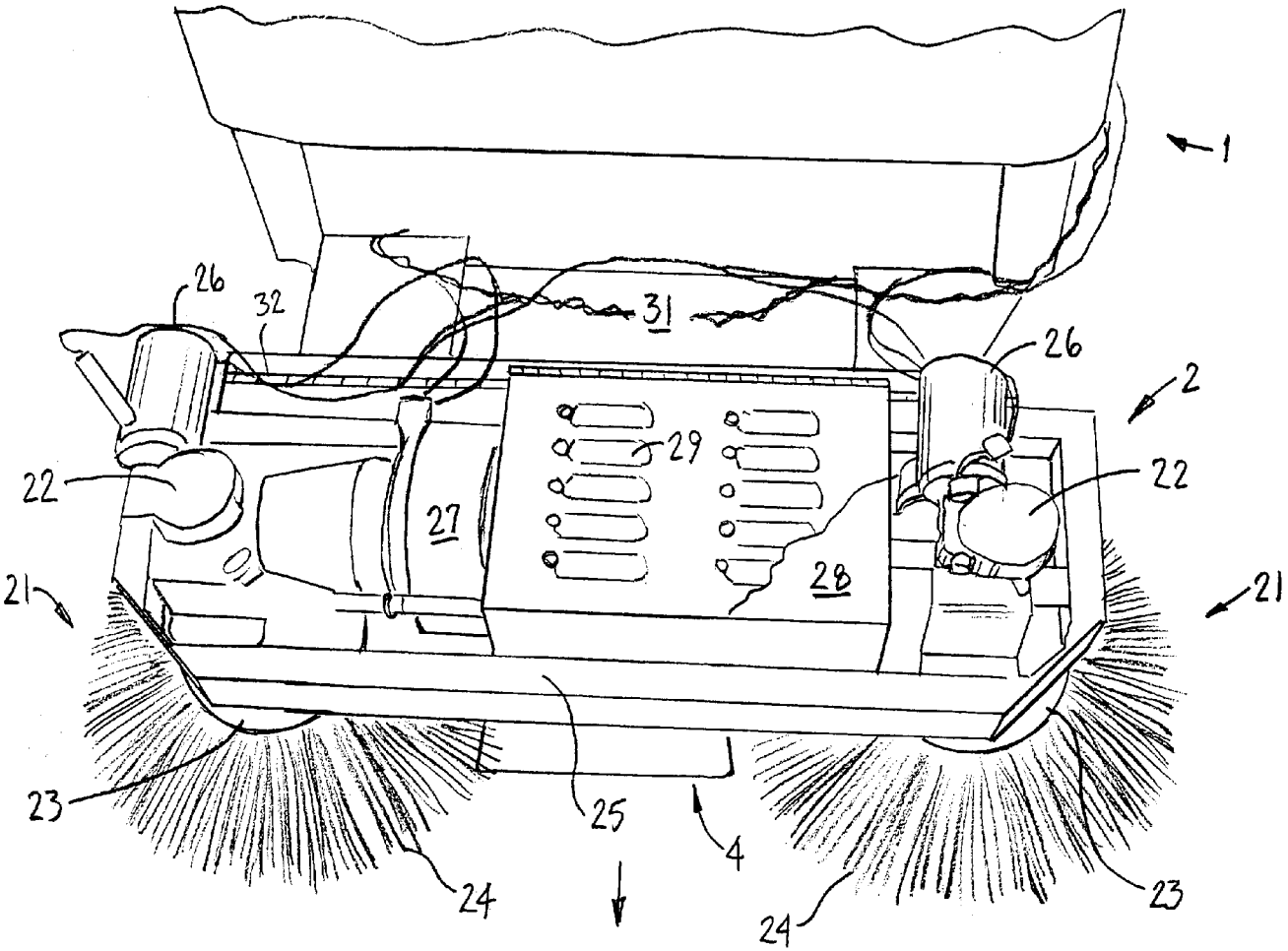
FIG. 2 is a top plan view of the vacuum sweeper illustrating the counter-rotating conical brushes at either side of the central vacuum head, the central vacuum head, the overlying large debris ramp, and the attached vacuum apparatus for receiving fine debris from the vacuum.

Referring to FIG. 2, vacuum sweeper 2 is illustrated in plan. Here, vacuum sweeper 2 includes paired counter-rotating conical brushes 21. The reader will of course understand that while two such brushes are preferred, only one conical brush 21 is required for the practice of this invention.

Rotating conical brushes 21 have a vertical axis of brush rotation 22. The brushes rotate from a shaft attached to the truncated apex of the conical brush 23. The rotating conical brushes 21 extend downwardly to an expanded base of conical brush 24 which is in contact with the floor. Conical brushes 21 are mounted to vacuum sweeper body 25. Brush motors 26 cause the conical brushes 21 to counter-rotate with respect to one another. In the view of FIG. 2, left brush 21 rotates counterclockwise while right brush 21 rotates clockwise. This rotation occurs while vacuum sweeper 2 attached to automatic scrubber 1 proceeds downwardly to and towards the floor to be swept and vacuumed as shown in FIG. 2. It will be noted that central vacuum head 4 is located between counter-rotating conical brushes 21. The rotation of brushes 21 serves to sweep debris into this central vacuum head 4 for accumulation to collection container 29 by suction of vacuum apparatus 27.

Continuing with the view of FIG. 2, vacuum sweeper body 25 supports vacuum apparatus 27. Vacuum collection container 29 contains a micro filter bag 28 for accumulating the debris fines in advance of the vacuum sweeper 2. The micro filter bag 28 is confined within the vacuum collection container 29.

Referring to FIG. 2, vacuum sweeper mounting bracket 3 (See FIG. 1) is shown mounted to the front end of automatic scrubber 1 at mounting bracket 31. Hinge 32 is placed between vacuum sweeper body 25 and bracket 31. This enables vacuum sweeper 2 to either be placed in confrontation to the floor or to be moved to a pivoted position up and away from the floor, preferably at 90 degrees with respect to the position of the vacuum sweeper 2 illustrated in FIG. 1.

Figure 4:
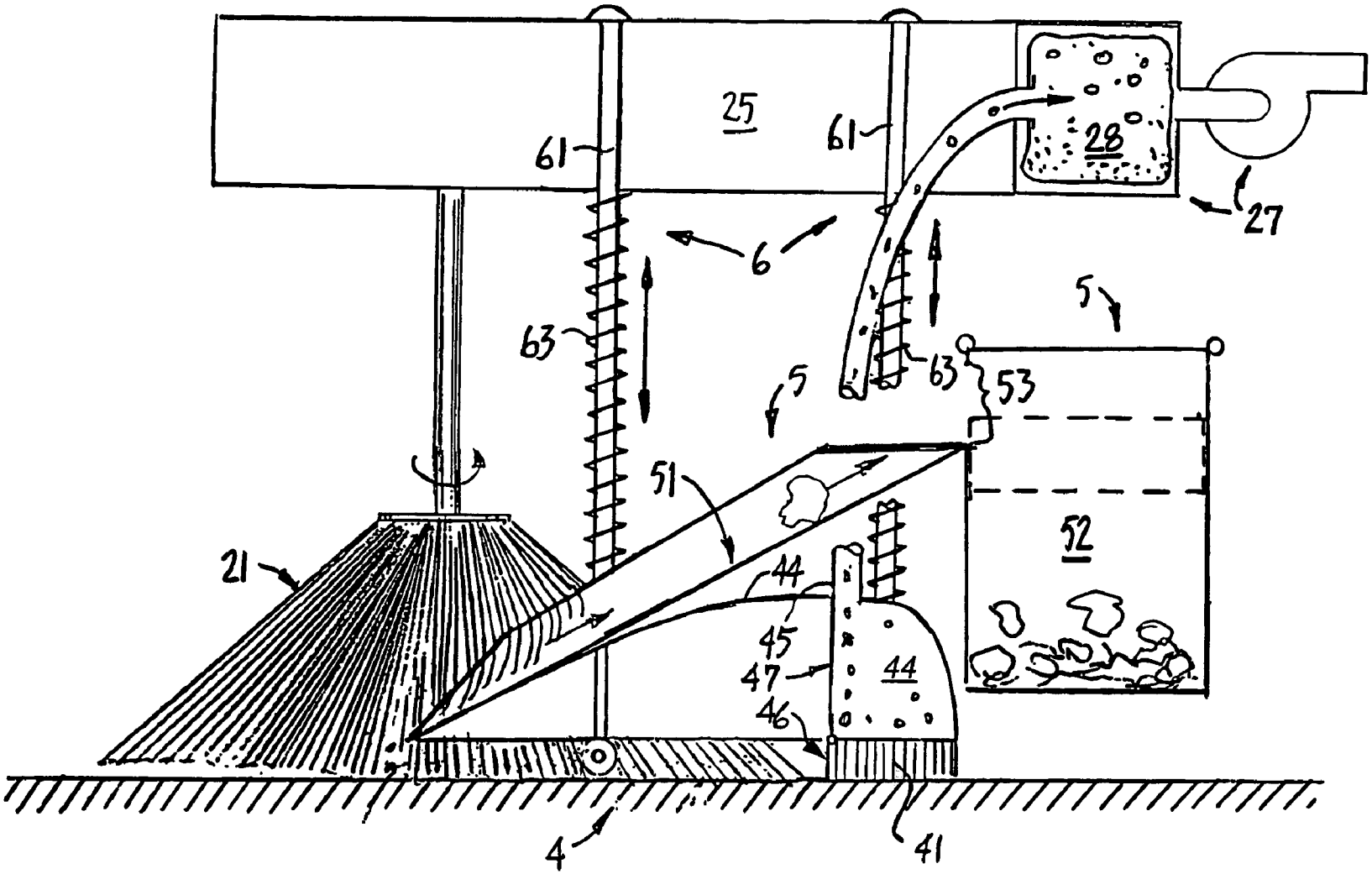

Referring to FIG. 4, vacuum head 4 can be seen in detail. With respect to the floor, vacuum head 4 has a top central shell 44 covering the top of the vacuum head. This top central shell 44 is communicated at opening 45 to vacuum apparatus 27. Thus, fine debris drawn centrally of central vacuum head 4 will end up in micro filter bag 28 of vacuum apparatus 27.

Support of central vacuum head 4 relative to the floor occurs at peripheral wall 41. Preferably, peripheral wall 41 is made from a soft, pliable floor contacting material. Here, the soft floor contacting material constitutes a continuous U-shaped bristle brush which forms the peripheral wall. This bristle brush has a thickness and density so that a conformable, substantially airtight barrier is formed as the brush slides over the flooring. Peripheral wall 41 surrounds central vacuum head 4 along the rear and at the sides. The peripheral wall 41 terminates at gap 46. Finally, floor contacting members 43, here shown as wheels, suspend central vacuum head 4 at a constant elevation relative to the floor in the vicinity of gap 46. This defines a constant spatial gap, the function of which can be understood with respect to FIG. 4.

I provide a second gap 46 defined by vacuum head partition 47. This divides vacuum head 4 into a rear suction chamber 44 which communicates directly to opening 45 to having micro filter bag 28 in vacuum apparatus 27. The provision of second gap 46 assures concentration of the vacuum energy at the rear of vacuum head 4 to effect efficient removal of vacuumed fines with minimum supplied vacuum.

Figure 3:
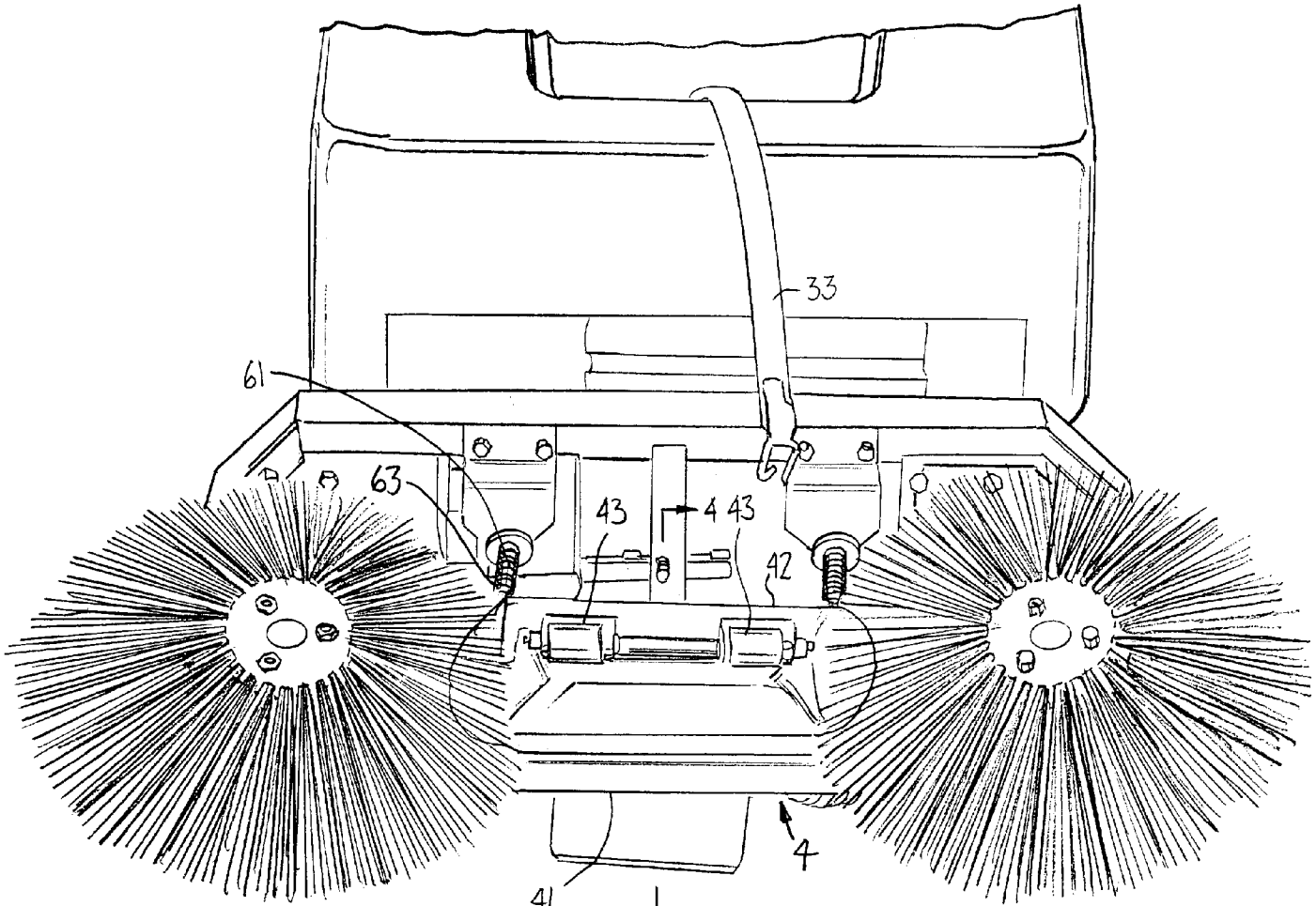
FIG. 3 is a bottom plan view of the vacuum sweeper illustrating the conical base of the counter-rotating brushes, the bottom of this central vacuum head, the wheels for supporting the leading edge of the central vacuum head overlying the floor to define a measured gap with respect to the floor for concentrating vacuum intake through the gap, and the peripheral surrounding bristle wall for forming the support point of the central vacuum head relative to the floor; and, FIG. 4 is a schematic side elevation section taken along lines 4—4 of FIG. 3 illustrating gathering of large debris to the overlying debris ramp and vacuuming of small debris to the central vacuum head.

Referring to FIG. 4, a section of vacuum head 4 taken along lines 4—4 of FIG. 3 is shown. Specifically, despite variations in the level of the floor, it will be seen that floor contacting members 43 support central vacuum head 4 with gap 46 supported at a constant distance from the floor surface. With this support, the suction of vacuum apparatus 27 is maximized in the gap 46 between the vacuum head 4 and the floor. This assures that debris fines will be gathered to the vacuum head 4. As a practical matter I have found that any separation of vacuum head 4 from the floor surface destroys the effectiveness of the vacuuming that I desire.

Referring further to FIG. 4, the function of large debris accumulator 5 can be understood. Large debris ramp 51 is shown immediately overlying vacuum head 4. Large debris ramp 51 empties at the top to large debris bin 52. Large debris bin 52 has a large debris bin opening 53. The large debris bin 52 is drawer mounted to the underside or rear of vacuum sweeper body 25. This arrangement enables the large debris bin to be selectively removed and emptied when filled.

It is easy to understand filling of the large debris bin 52 with respect to FIG. 4. Specifically, rotating conical brushes 21 advance and rotate all debris, large and small, to and towards central vacuum head 4 and overlying large debris ramp 51. Debris fines, which seriously interfere with the scrubbing process, are accumulated by the vacuum apparatus 27 to the micro filter bag 28. At the same time, larger debris particles are swept up large debris ramp 51 into large debris bin 52 by the rotation of the rotating conical brushes 21. Large debris particles such as wrappers, paper scraps, small sticks, and other debris are rapidly accumulated within large debris bin 52. It will be noticed that at least some of the bristles protruding at the expanded base of conical brush 24 partially climb large debris ramp 51 assuring propulsion of the large debris particles up the ramp and into the waiting bin. Other brushes may be used for this require propulsion.

Finally, with respect to FIG. 4, it will be remembered that automatic scrubber 1 in the vicinity of vacuum sweeper 2 undertakes considerable excursion with respect to the floor. This excursion arises because of variations in floor height as well as natural rocking of scrubber 1. This being the case, vertical bias suspension 6 is provided between vacuum sweeper body 25 and vacuum sweeper head 4. Specifically, a series of rods 61 gravitationally suspends vacuum sweeper head 4 with respect to vacuum sweeper mounting attached to vacuum sweeper body 25. As either the floor height varies or automatic scrubber 1 rocks, vacuum sweeper head 4 will remain in the same firm contact with the floor. As a result, consistent sweeping and vacuuming will result. It is preferred to have coil springs 63 biasing vacuum sweeper body 25 to and toward the floor.

The reader will understand that the above preferred embodiment can vary within wide limits. For example only one rotating conical brush 21 is required. Further, although a vertical axis of brush rotation is preferred, axes other than vertical may be used as well. For example, cylindrical brushes could be used as well. Further, while we show a conical brush, other brush shapes could be used as well. We illustrate a vacuum sweeper body 25; this body could take any form including joining some or all of the operative parts of vacuum sweeper 2 together. It will be understood that the vacuum sweeper mounting bracket 3 will change form to accommodate any portion of automatic scrubber 1 and any particular model of automatic scrubber 1 to which mounting is required. Further, while hinge 32 is preferred, it is not required. For example, the vacuum sweeper 2 could merely be elevated on rods 61.

I prefer a vacuum sweeper retainer 33 to retain vacuum sweeper 2 from the horizontal position where vacuuming and sweeping is not required, especially during certain portions of double scrubbing and the floor stripping. Sweeper retainer 33 can take many forms. Here it is illustrated as a strap. Alternately, it could either be a mechanical lever, cable, solenoid apparatus, electric actuator, or of many formats to move vacuum sweeper 2 relative to hinge 32 on vacuum sweeper mounting bracket 3.

Likewise it will be understood that central vacuum head 4 will admit of change. While the construction utilizing the gap 46, peripheral wall 41, and floor contacting member 43 is preferred, other vacuum heads incorporated with rotating conical brushes 21 will suffice. For example, where high horsepower vacuuming devices are used, the care taken with respect to gap 46 can be compromised. Further, while I illustrate floor contacting members in the form of wheels, slides, guides, pads, and others supporting members could as well be used.

It will be understood that the large debris accumulator 5 is not a requirement of this invention. I concentrate on collecting the fine debris in order to prevent the phenomenon of "mud" in the wake of scrubber 1. It will be understood that the entire scrubbing process could proceed without the specific collection of large debris by the vacuum sweeper 2.

Other variations can occur to accommodate specific circumstance.

What is claimed is:

1. A vacuum sweeper for a floor scrubber comprising in combination:

vacuum apparatus including a debris bag for accumulating debris from the vacuum apparatus;

a vacuum head communicated to the vacuum apparatus, the vacuum head having a peripheral floor contacting wall and a gap defining a substantially constant interval over the floor;

a debris ramp overlying the vacuum head at the gap for receiving debris; and, a debris bin communicated to the debris ramp having an opening to the ramp for receiving debris swept over the ramp;

at least one brush at a side of the vacuum head to sweep the floor at the side of the vacuum head to the vacuum head;

means for rotating the brush for sweeping debris to the vacuum head at the gap to vacuum the floor at the front of the sweeper and debris over the gap onto the ramp and into the debris bin;

a bracket for mounting to a front of the floor scrubber to suspend the vacuum sweeper overlying the floor at a front of the floor scrubber; and, a suspension for permitting up-and-down movement of the vacuum sweeper relative to the bracket to maintain vacuum sweeper contact with the floor during up-and-down movement of the scrubber relative to the floor.

2. The vacuum sweeper for a floor scrubber according to claim 1 and further including:

floor contacting means on the vacuum head for supporting the edge of the vacuum head a predetermined distance from the floor.

3. The vacuum sweeper for a floor scrubber according to claim 1 and further including:

a hinge between the bracket and sweeper for permitting pivotal movement of the vacuum sweeper into and out of contact with the floor in front of the scrubber.

4. The vacuum sweeper for a floor scrubber according to claim 1 and further including:

the suspension for permitting up-and-down movement of the vacuum sweeper relative to the bracket includes means for biasing the vacuum sweeper to and towards the floor.

5. The vacuum sweeper for a floor scrubber according to claim 1 and further including:

the peripheral floor contacting wall comprises a soft floor contacting surface.

6. The vacuum sweeper for a floor scrubber according to claim 5 and further including:

the peripheral floor contacting wall of the vacuum head includes bristles mounted in side-by-side relation so as to be a barrier to air whereby vacuum intake is concentrated at the gap of the vacuum head.

7. The vacuum sweeper for a floor scrubber according to claim 1 and further including:

the brush is a rotating brush.

8. The vacuum sweeper for a floor scrubber according to claim 7 and further including:

the at least one brush includes two counter rotating conical brushes rotatable at the sides of the vacuum head, each brush for sweeping debris to the vacuum head at the gap to vacuum the floor at the front of the sweeper.

9. The vacuum sweeper for a floor scrubber according to claim 7 and further including:

the brush is a conical rotating brush rotating about a vertical axis.

10. A process for utilizing a vacuum sweeper for a floor scrubber to sweep and vacuum a floor from the front of the floor scrubber comprising the steps of:

providing vacuum apparatus including a debris bag for accumulating debris from the vacuum apparatus;

providing a vacuum head communicated to the vacuum apparatus, the vacuum head having a peripheral floor contacting wall and a gap defining a substantially constant interval over the floor;

operating the vacuum apparatus to accumulate debris to the vacuum head at the gap and into the debris bag of the vacuum apparatus;

providing a debris ramp overlying the vacuum head at the gap for receiving debris;

providing a debris bin at the top of the debris ramp having an opening to the ramp for receiving debris swept over the ramp;

providing at least one brush at a side of the vacuum head to sweep the floor at the side of the vacuum head into the vacuum head; and, rotating the brush for impelling debris to the vacuum head at the gap for sweeping and vacuuming the floor at the front of the sweeper;

providing a bracket for mounting to a front of the floor scrubber to suspend the vacuum sweeper overlying the floor at a front of the floor scrubber;

suspending the vacuum sweeper to permit up-and-down movement of the vacuum sweeper relative to the bracket to maintain vacuum sweeper contact with the floor during up-and-down movement of the scrubber relative to the floor.

11. The vacuum sweeper for a floor scrubber according to claim 1 and further including:

the peripheral floor contacting wall of the vacuum head is provided with bristles mounted in side-by-side relations so as to be a barrier to air whereby vacuum intake is concentrated at the gap of the vacuum head.

12. The process for utilizing a vacuum sweeper for a floor scrubber according to claim 10 and including the further step of:

providing floor contacting means on the vacuum head for supporting the edge of the vacuum head a predetermined distance from the ground.

13. The process for utilizing a vacuum sweeper for a floor scrubber according to claim 10 and including the further steps of:

providing a hinge between the bracket and sweeper for permitting pivotal movement of the vacuum sweeper into and out of contact with the floor in front of the scrubber; and, moving the vacuum sweeper on the hinge into and out of contact with the floor in front of the scrubber.

14. The process for utilizing a vacuum sweeper for a floor scrubber according to claim 10 and including the further step of:

biasing the vacuum sweeper to and towards the floor.

15. The process for utilizing a vacuum sweeper for a floor scrubber according to claim 10 and including the further step of:

the step of providing at least one brush at a side of the vacuum head includes providing two counter-rotating conical brushes rotatable at the sides of the vacuum head, each brush for sweeping debris to the vacuum head at the gap to vacuum the floor at the front of the sweeper.

16. A vacuum sweeper for vacuuming and sweeping a floor comprising:

a vacuum head communicated to vacuum apparatus for accumulating debris to the vacuum apparatus;

a peripheral wall extending downwardly from the vacuum head for forming a support for the vacuum head from the floor and providing a substantial airtight barrier between the floor and vacuum head;

a lip forming a substantially constant size gap between the floor and vacuum head for permitting debris to be drawn into vacuum head from the exterior of the vacuum head under the lip;

a debris ramp overlying the vacuum head at the gap for receiving debris;

a debris bin communicated to the debris ramp having an opening to the ramp for receiving debris swept over the ramp;

at least one rotating brush for sweeping debris towards the lip and for sweeping debris up the ramp to the debris bin;

a suspension connecting the floor sweeper body and the vacuum head for permitting relative up and down movement between the floor sweeper body and the vacuum head; and, floor contacting means supported from the vacuum head for maintaining the lip relative to the floor to form the substantially constant sized gap between the floor and vacuum head.

17. The vacuum apparatus for mounting from a floor scrubber for vacuuming the floor in combination with the sweeper according to claim 16 and further comprising:

bristles included in the peripheral wall for providing the substantial airtight barrier between the floor and vacuum head.

18. The vacuum apparatus for mounting from a floor scrubber for vacuuming the floor in combination with the sweeper according to claim 16 and further comprising:

the floor contacting means includes wheels supported from the vacuum head.

* * * * *